US008136688B2

(12) United States Patent
Lee et al.

(10) Patent No.: US 8,136,688 B2
(45) Date of Patent: Mar. 20, 2012

(54) TRASH CAN ASSEMBLY

(75) Inventors: Judy Lee, Taipei (TW); Tony Ho, Taipei (TW)

(73) Assignee: Test Rite Products Corp., Ontario, CA (US)

( * ) Notice: Subject to any disclaimer, the term of this patent is extended or adjusted under 35 U.S.C. 154(b) by 377 days.

(21) Appl. No.: 12/471,276

(22) Filed: May 22, 2009

(65) Prior Publication Data

US 2010/0294769 A1 Nov. 25, 2010

(51) Int. Cl.
*B65D 43/26* (2006.01)
*B65D 25/14* (2006.01)

(52) U.S. Cl. ... 220/262; 220/263; 220/264; 220/495.01; 220/495.06; 220/908

(58) Field of Classification Search ..... 220/262, 220/263, 264, 495.01, 495.06, 908
See application file for complete search history.

(56) References Cited

U.S. PATENT DOCUMENTS

| | | | |
|---|---|---|---|
| 1,503,015 | A | 7/1924 | Barnsted |
| 1,820,555 | A | 8/1931 | Buschman |
| 1,891,651 | A | 12/1932 | Padelford et al. |
| 1,893,743 | A | 1/1933 | Hirshman |
| 2,549,572 | A | 4/1951 | Campanelli |
| 2,759,625 | A | 8/1956 | Ritter |
| 2,946,474 | A | 7/1960 | Knapp |
| 3,008,604 | A | 11/1961 | Garner |
| 3,654,534 | A | 4/1972 | Fischer |
| 3,825,215 | A | 7/1974 | Borglum et al. |
| 3,891,115 | A | 6/1975 | Ono |
| 4,014,457 | A | 3/1977 | Hodge |
| 4,081,105 | A | 3/1978 | Dagonnet et al. |
| 4,200,197 | A | 4/1980 | Meyer et al. |
| 4,558,799 | A | 12/1985 | Hammond |
| 4,765,548 | A | 8/1988 | Sing |
| 4,913,308 | A | 4/1990 | Culbertson |
| 4,918,568 | A | 4/1990 | Stone et al. |
| 5,065,272 | A | 11/1991 | Owen et al. |
| 5,111,958 | A | 5/1992 | Witthoeft |
| 5,147,055 | A | 9/1992 | Samson et al. |
| 5,170,904 | A | 12/1992 | Neuhaus |
| 5,174,462 | A | 12/1992 | Hames |
| 5,230,525 | A | 7/1993 | Delmerico et al. |
| 5,249,693 | A | 10/1993 | Gillispie et al. |
| 5,322,179 | A | 6/1994 | Ting |
| 5,328,048 | A | 7/1994 | Stein |
| 5,348,222 | A | 9/1994 | Patey |
| 5,385,258 | A | 1/1995 | Sutherlin |
| 5,390,818 | A | 2/1995 | LaBuda |
| 5,452,847 | A | 9/1995 | Harris et al. |
| 6,000,569 | A | 12/1999 | Liu |
| 6,010,024 | A | 1/2000 | Wang |
| 6,024,238 | A | 2/2000 | Jaros |
| 6,039,200 | A | 3/2000 | Armor |
| 6,390,321 | B1 | 5/2002 | Wang |
| 6,837,393 | B1 | 1/2005 | Kuo |
| 6,883,676 | B2 | 4/2005 | Lin |

(Continued)

*Primary Examiner* — Anthony Stashick
*Assistant Examiner* — Madison L Wright
(74) *Attorney, Agent, or Firm* — Tsircou Law, P.C.

(57) ABSTRACT

A trash can assembly is provided having an outer shell and a lid pivotally coupled to the shell for movement between an open position and a closed position. A foot pedal is operatively coupled to the lid such that pressing down on the pedal caused the lid to open. A fluid damper is mounted to dampen the downward movement of a lid. The damper engages a support surface operatively coupled to the lid such that the support surface moves in conjunction with movement of the lid as the lid moves between the open position and the closed position, and yet the fluid damper is unsecured to the support surface.

17 Claims, 6 Drawing Sheets

U.S. PATENT DOCUMENTS

| | | | |
|---|---|---|---|
| 6,920,994 | B2 | 7/2005 | Lin |
| 6,981,606 | B2 | 1/2006 | Yang et al. |
| 7,121,421 | B2 | 10/2006 | Yang et al. |
| 7,374,060 | B2 | 5/2008 | Yang et al. |
| 2005/0103788 | A1 | 5/2005 | Yang et al. |
| 2005/0284870 | A1 | 12/2005 | Yang et al. |
| 2006/0027579 | A1 | 2/2006 | Yang et al. |
| 2006/0186121 | A1 | 8/2006 | Yang et al. |
| 2006/0213910 | A1 | 9/2006 | Yang et al. |
| 2007/0012699 | A1 | 1/2007 | Yang et al. |
| 2007/0029323 | A1 | 2/2007 | Yang et al. |
| 2007/0090112 | A1 | 4/2007 | Kalman et al. |

TRASH CAN ASSEMBLY

FIELD OF THE INVENTION

The present invention relates generally to trash cans and, more particularly, to trash cans having dampening mechanism for the closing motion of a lid.

BACKGROUND OF THE INVENTION

Numerous trash can configurations include lids to hide trash from view and to control odor emanations. More particularly, many trash cans have a foot pedal that controls opening of the lid, often referred to as step cans. In use, a user step on the pedal to open the lid, and the lid closes once the user removes his foot from the pedal.

Although such step cans are generally effective, shortfalls exist. For example, many conventional step cans are unduly loud. In its closing operation after the user removes his foot, the lid often closes with excessive force, resulting in an unpleasant banging sound and undue wear on components. Certain step can configurations have attempted to resolve this issue with various dampening mechanism. Commonly, such mechanism are coupled between the foot pedal and lid in such a manner that impact operation of the lid throughout its entire range of motion, which can negatively impact free movement in opening the lid.

It should, therefore, be appreciated that there remains a need for a trash can assembly that addresses these shortfalls. The present invention fulfills this need and others.

SUMMARY OF THE INVENTION

The invention provides a trash can having an outer shell and a lid pivotally coupled to the shell for movement between an open position and a closed position. A foot pedal is operatively coupled to the lid such that pressing down on the pedal caused the lid to open. A fluid damper is mounted to dampen the downward movement of a lid. The damper engages a support surface operatively coupled to the lid such that the support surface moves in conjunction with movement of the lid as the lid moves between the open position and the closed position, and yet the fluid damper is unsecured to the support surface.

In a detailed aspect of an exemplary embodiment of the invention, the fluid damper is positioned proximate to a hinge assembly that couples the lid and the outer shell together. The damper includes an upper and configured to contact a lid throughout the lids movement within a lower portion of its operable range. More particularly, the damper is mounted such that the first end is engaged by the support surface through a lower portion of the operable range of the lid and such that the first end of the damper is disengaged from the support surface through an upper portion of the operable range of the lid.

In another detailed aspect of an exemplary embodiment, the hinge assembly included a cam that defines a support surface that interacts with the upper end of the damper.

In yet another detailed aspect of an exemplary embodiment, the damper is coupled to an interior surface of the outer shell and a support surface is attached to a link rod operatively coupled to the foot pedal and the lid.

In an exemplary embodiment of the invention, the trash can includes a link rod having a lower end couple to the pedal and an upper end couple to the lid and further includes a support member coupled to the link rod that provides the support surface for engaging the fluid damper. The support member can include a first portion attached to the link rod and a second portion that provides a support surface. The trash can may further include a spring coupled to the lid and to the support member.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
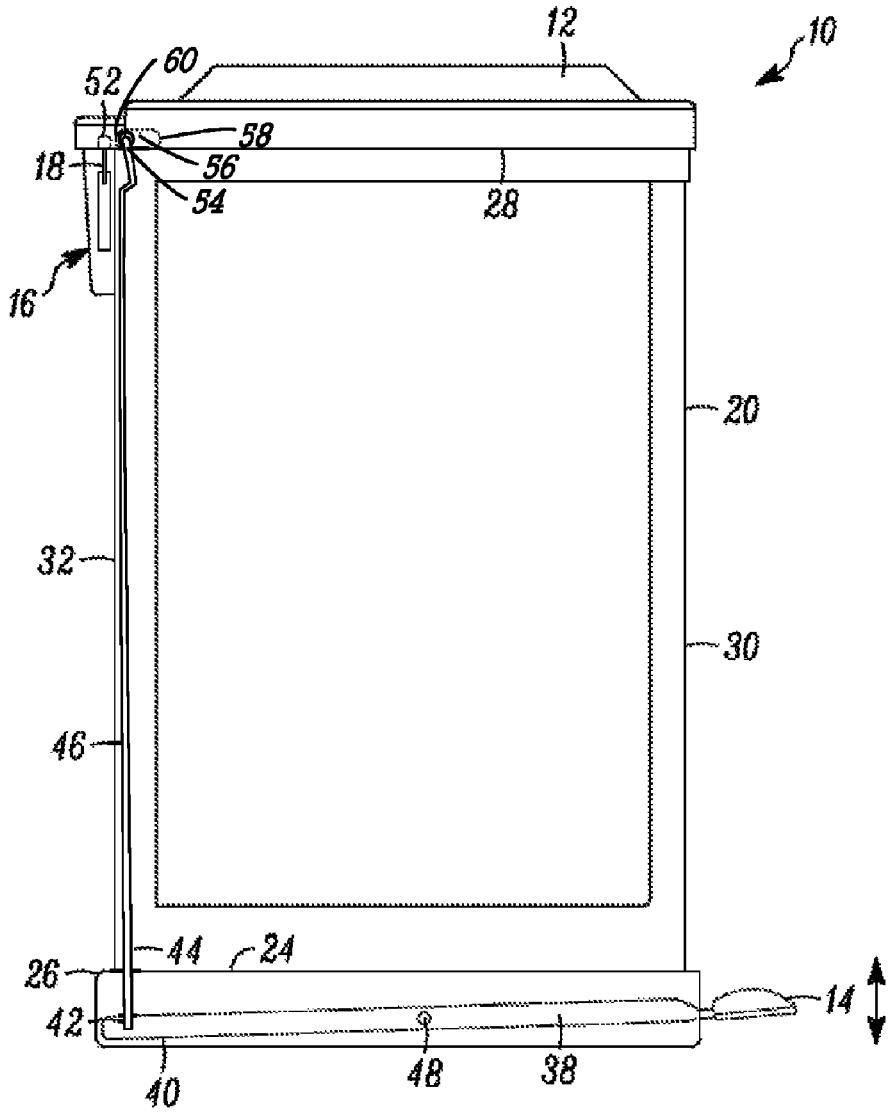
FIG. 1 is a cross-sectional view of a first embodiment of a trash can in accordance with the invention, depicting a lid in a closed position and a piston configured to engage a support surface to aid in operation of the lid.
Figure 2:
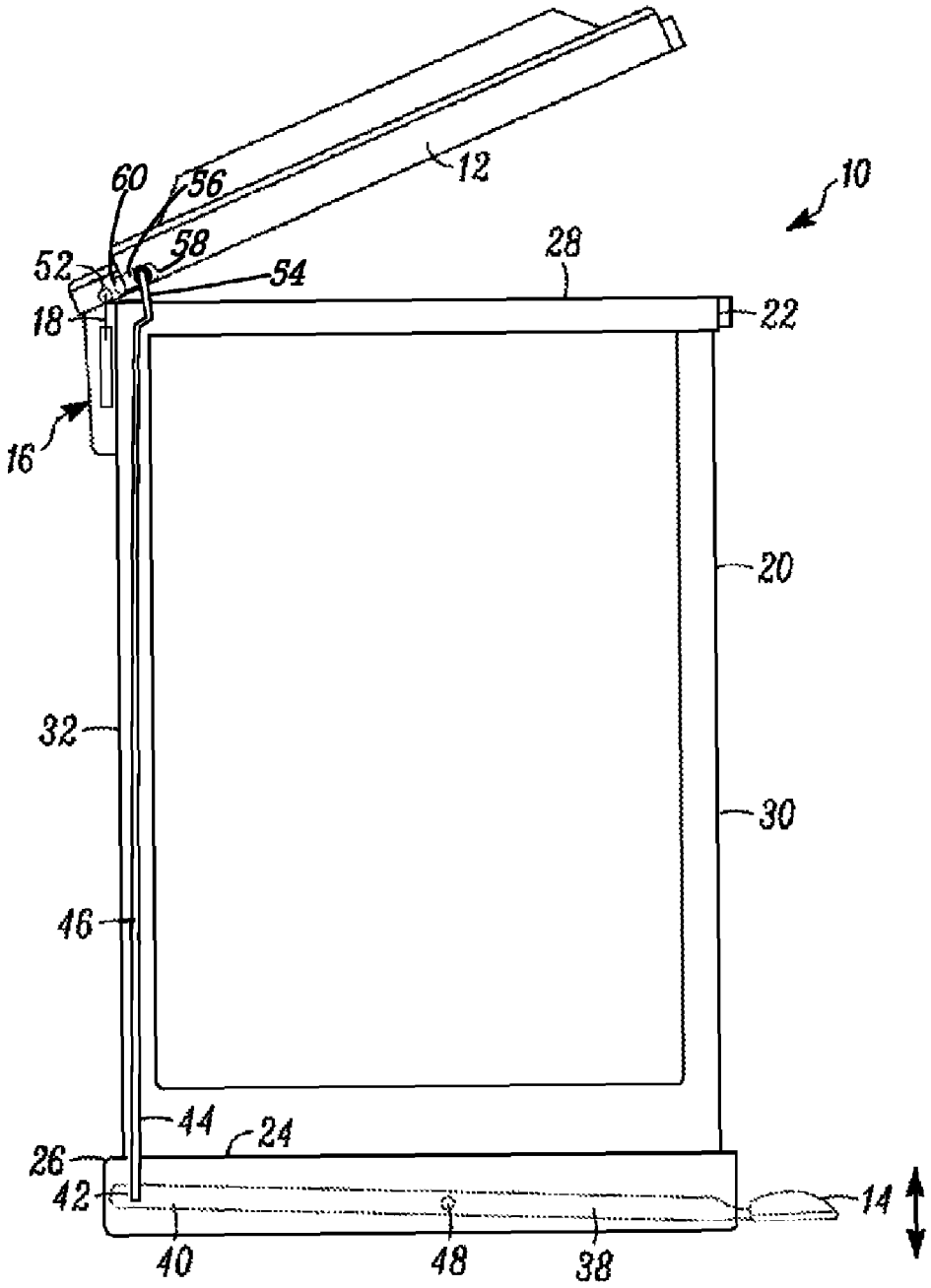
FIG. 2 is a cross-sectional view of the trash can of FIG. 1, depicting the lid in an open position.

Referring now to the drawings, and particularly FIG. 1, there is shown a trash can 10 having a lid 12 operable by a foot pedal 14. The trash and further includes a dampening mechanism 16 mounted to regulate closing motion of the lid. The dampening mechanism includes a damper piston 18 housed within a body 19, mounted proximate to the upper end of the trash can. In use, the lid presses down upon a pin 21 of the piston, causing the piston to apply force onto fluid within the housing, providing a dampening action in at least lower portion of the range of motion of the lid, as the lid closes.

The trash can 10 includes an outer shell 20 having an upper end 22 and a lower end 24. A base 26 is secured to the lower end of the outer shell, and an upper ridge 28 is secured to the upper end of the outer shell. The outer shell is formed of stainless steel and is configured with a four-sided configuration, including a front wall 30, a rear wall 32, and two side walls. In other embodiments, various other configurations, shapes, and materials can be used, e.g., steel, tin, aluminum, plastics, and so on. In addition, the outer shell, the upper ridge, and the base need not be formed of the same material or excluded entirely.

The base 26 circumscribes the lower end 24 of the outer shell, providing a floor support for the trash can 10. The foot pedal 14 is integrally formed with a pedal bar 38, such that a first end of the pedal bar extends beyond the front wall 30 and defines the foot pedal. A second end 40 of the pedal bar is disposed proximate to the rear wall 32 and provides attachments 42 for securing a lower end 44 of a lifting rod 46. The pedal bar is pivotally coupled to the base via a pivot rod 48.

A link, e.g., the lifting rod 46, is provided that couples the foot pedal 14 to the lid 12. The lifting rod extends from the second end 40 of the pedal bar to an upper attachment 50 provided proximate to a hinge 52. The upper end 54 of the lifting rod extends through apertures 56 defined by the upper attachment 50.

The apertures 56 have an arcuate configuration having a first end 58 and a second end 60. In use, lifting rod 46 is thrust upwards by the pedal bar, causing the upper end 54 of the lift rod to press against the first end 58 of the apertures, which in turn causes the lid 12 to pivot open about the hinge 52. In addition, the user can lift the lid from the open position arrived at by stepping on the foot pedal to a self-supported position in which the upper ends 54 of the lifting rod are positioned at the second end 60 of the apertures.

Figure 3:
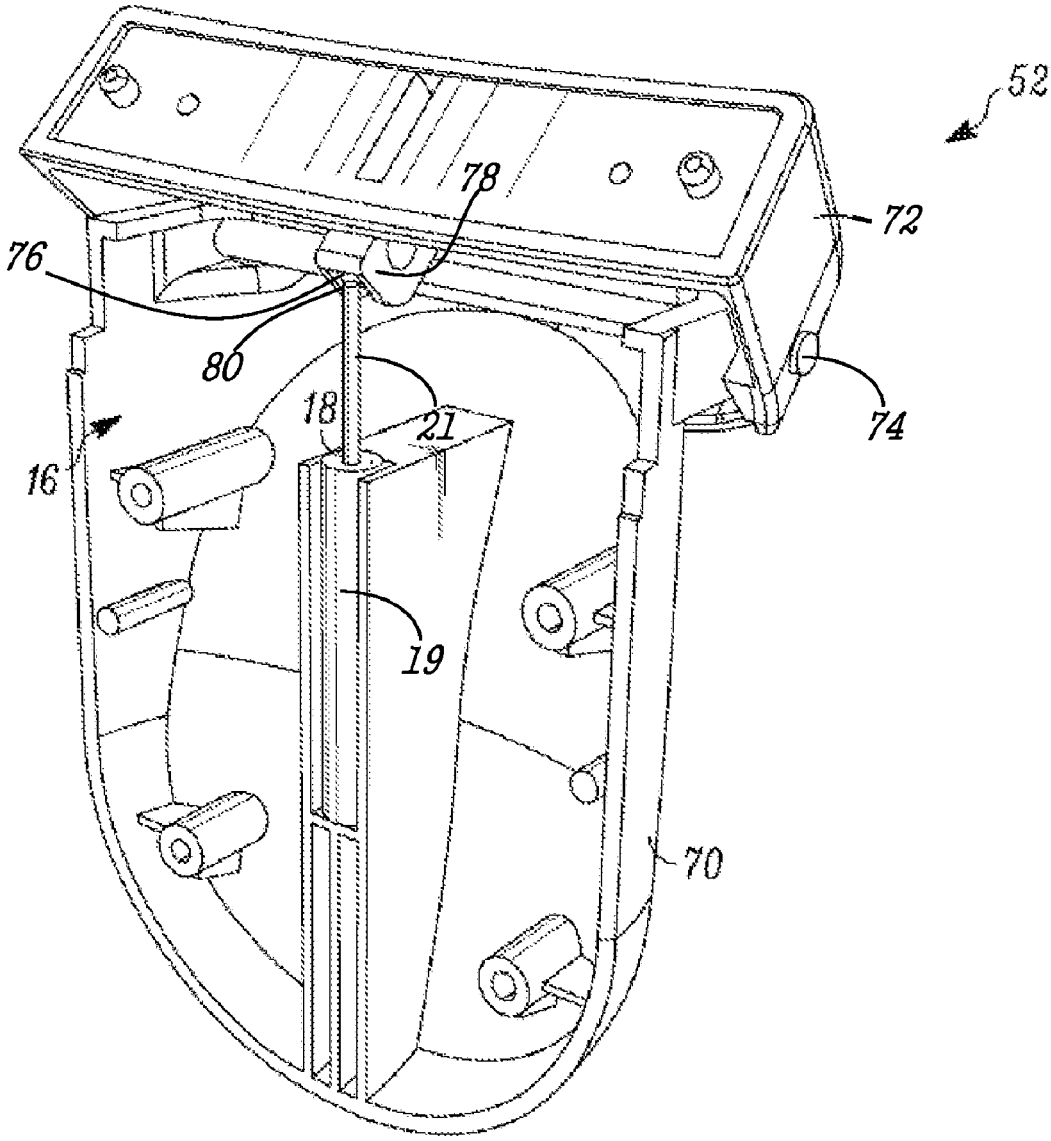
FIG. 3 is a perspective view of a hinge assembly of the trash can of FIG. 1, depicting a piston engaging a support surface of an upper portion of the hinge assembly.

With reference now to FIG. 3, the hinge assembly 52 includes a lower portion 70 attached to an outer surface of the outer shell and an upper portion 72 attached to the lid 12. The lower portion and the upper portion are rotationally coupled together by a rod 74 that defines an axis of rotation for the lid. The lower portion defines a recess for housing the damper piston 18, and the upper portion includes a support surface 76 configured to interact with the upper end of the damper piston. More particularly, the upper portion includes a notch 78 that defines the support surface. Notably, the upper end of the damper piston is not affixed to the notch. Thus, the user can lift the lid manually without encountering resistance imparted by the damper piston.

In use, the first end 80 of the damper piston is engaged by the support surface 76 through a lower portion of the operable range of the lid 12. In an upper portion of the operable range of the lid, the first end of the damper piston is disengaged from the support surface.

Figure 4:
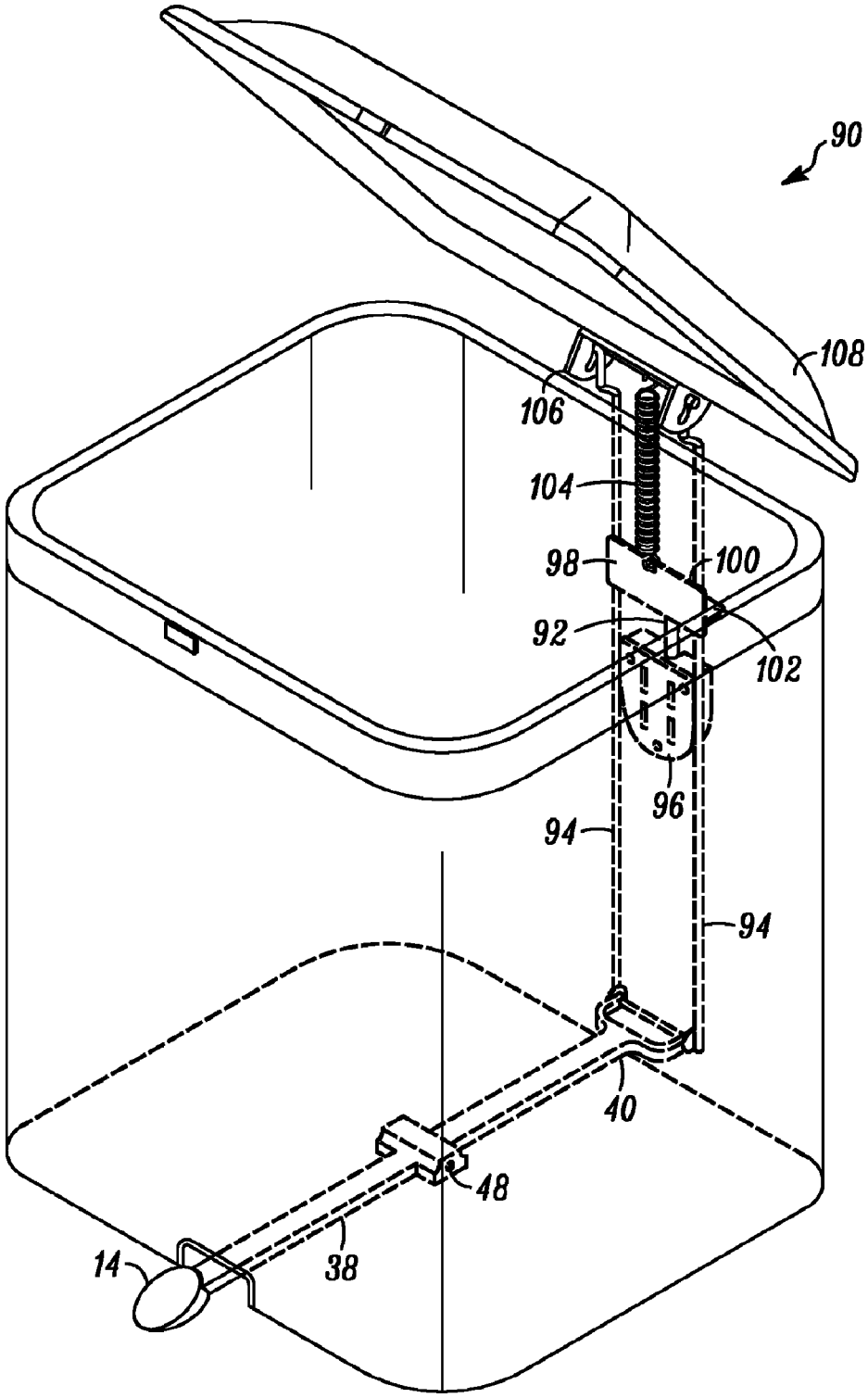
FIG. 4 is a cross-sectional perspective view of a second embodiment of a trash can in accordance with the invention, depicting a lid in an open position and a piston configured to engage a support surface to aid in operation of the lid.
Figure 5:
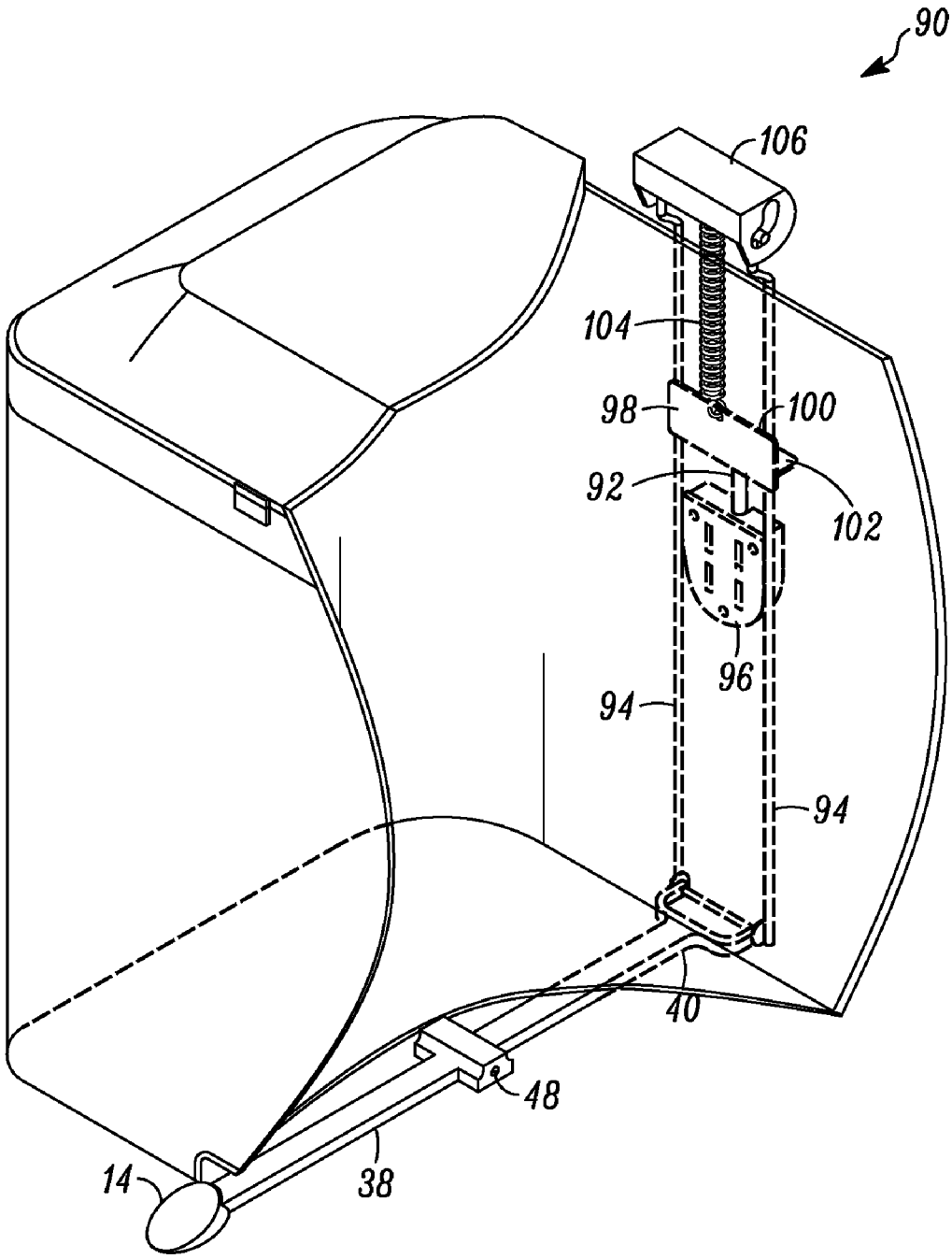
FIG. 5 is a cross-sectional, partially cut-out view of the trash can of FIG. 4, depicting the lid in a closed position, the trash can having an outer shell (not shown).
Figure 6:
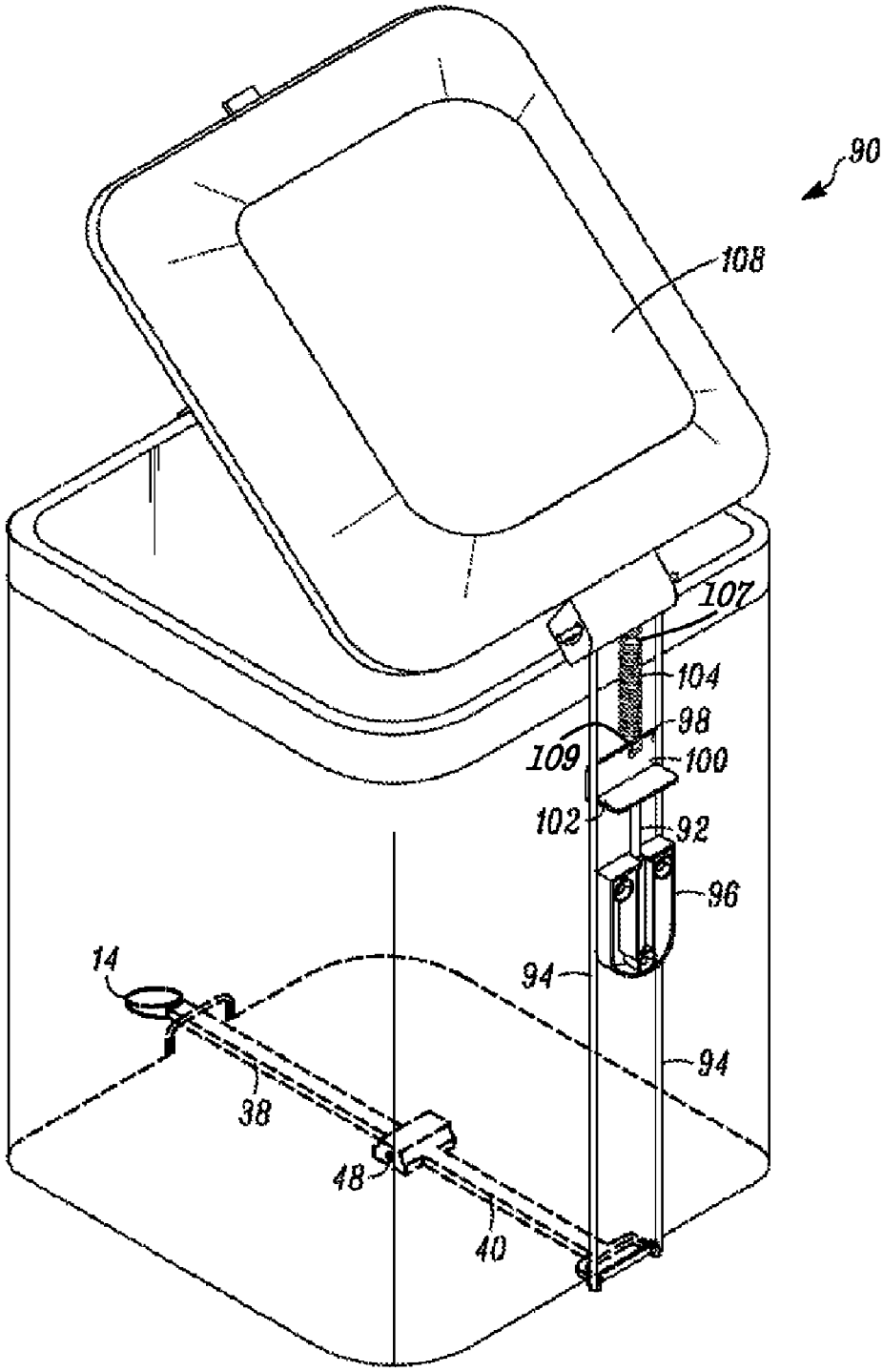
FIG. 6 is a rear perspective view of the trash can of FIG. 4, depicting the lid in an open position, the trash can having an outer shell (not shown).

With reference now to FIGS. 4-6, a trash can 90 is shown, having a damper, i.e., fluid damper 92, mounted in an intermediate region of the trash can, proximate to lifting rods 94. The damper piston is disposed in a damper housing 96 mounted to the interior surface of the outer shell. A support member 98 is coupled to the lifting rods above the damper piston. The support member provides a support surface configured to engage the first end of the damper piston during operation of the lid. The support member includes a first portion 100 attached to the lifting rods and a second portion 102 oriented generally transverse to the first portion. The second portion provides the support surface above the damper piston.

In the exemplary embodiment, the support member 98 is formed of metal and affixed in the lifting rods. The first portion 100 defines an attachment location for a lower end of the spring 104. The upper end of the spring is attached proximate to a hinge assembly 106 that couples the lid 108 and the body.

The trash can 90 further includes a spring 104 that aids in operation of the lid. The spring has a first end 107 attached proximate to the hinge assembly 106 and a second end 109 attached proximate to an intermediate portion of the lifting rod. The second end of the spring is attached to the second portion 102 of the support member 98, which is coupled to the lifting rod so that it moves in conjunction with the lifting rod. The spring is attached in a manner that is biased to aid in the opening operation of the lid. The spring 104 is mounted to be in tension with the lid closed. When the user presses on the foot pedal to open the lid, the spring aids the upward motion of the lifting rods, facilitating ease of operation.

As the lid is closed, the second portion of the support member 98 engages the upper end of the damper, causing the damper piston to move axially within a cylindrical housing. The housing includes dampening fluid, which is acted upon by the damper piston. The resulting hydraulic pressure facilitates the dampening of the downward movement of the lid. In addition, as the lid closes, tension is applied to the spring 104, thereby further slowing closing operation of the lid. The combination of the spring and the dampening mechanism provides a controlled operational motion for the lid.

The trash can 90 includes an outer shell and an inner container for receiving the refuse. The lifting rods 94, the damper housing 96, the support member 98, and the spring 104 are disposed between the outer shell and the inner container. The damper housing 96 is mounted to inner surface of the outer shell. The trash can 90 includes a base (not shown) that circumscribes the lower end of the outer shell, providing a floor support for the trash can. The foot pedal 14 is integrally formed with a pedal bar 38, such that a first end of the pedal bar extends beyond the front wall of the outer shell and defines the foot pedal. A second end 40 of the pedal bar is disposed proximate to a rear wall of the outer shell and provides attachments 42 for securing a lower end of the lifting rods 94. The pedal bar is pivotally coupled to the base via a pivot rod 48.

It should be appreciated from the foregoing that the present invention provides a trash can having an outer shell and a lid pivotally coupled to the shell for movement between an open position and a closed position. A foot pedal is operatively coupled to the lid such that pressing down on the pedal caused the lid to open. A fluid damper is mounted to dampen the downward movement of a lid. The damper engages a support surface operatively coupled to the lid such that the support surface moves in conjunction with movement of the lid as the lid moves between the open position and the closed position, and yet the fluid damper is unsecured to the support surface.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A trash can, comprising:

an outer shell having an upper end and a lower end;

a lid pivotally coupled to the upper end of the outer shell for movement between an open position and a closed position, the open position and the closed position defining an operable range for the lid;

a foot pedal operatively coupled to the lid such that pressing down on the pedal caused the lid to open;

a support surface operatively coupled to the lid such that the support surface moves in conjunction with movement of the lid as the lid moves between the open position and the closed position; and a fluid damper having a piston disposed within a cylindrical housing, the damper further having a first end and a second end in which the damper is mounted such that the first end engages the support surface to dampen the downward movement of the lid, the first end being unsecured to the support surface, wherein the damper is mounted such that the first end is engaged by the support surface through a lower portion of the operable range of the lid and such that the first end of the damper is disengaged from the support surface through an upper portion of the operable range of the lid.

2. A trash can as defined in claim 1, wherein the damper is positioned proximate to a hinge assembly that couples the lid and the outer shell.

3. A trash can as defined in claim 1, wherein the damper having an upper end configured to contact the lid throughout the lid's movement within a lower portion of the operable range of the lid.

4. A trash can as defined in claim 1, wherein in the damper is coupled to an interior surface of the outer shell, and the support surface attached to a link operatively coupled to the pedal and the lid.

5. A trash can as defined in claim 1, wherein the lower portion of the operable range of the lid is between the closed position and about 20 degrees above the closed position.

6. A trash can as defined in claim 1, wherein the damper is disposed in an intermediate region inside the outer shell between the lid and the foot pedal.

7. A trash can as defined in claim 1, further comprising:

a link rod having a lower end coupled to the pedal and an upper end coupled to the lid, and a support member coupled to the link rod and that provides the support surface.

8. A trash can as defined in claim 7, wherein the support member includes a first portion attached to the lifting rod and a second portion that provides the support surface.

9. A trash can as defined in claim 8, further comprising a spring coupled to the lid and to the support member.

10. A trash can, comprising:

an outer shell having an upper end and a lower end;

a base secured to the lower end of the outer shell;

a lid pivotally coupled to the upper end of the outer shell for movement between an open position and a closed position, the open position and the closed position defining an operable range for the lid;

a pedal pivotally coupled to the base, and operatively coupled to the lid such that pressing down on the pedal caused the lid to open; and a damper disposed proximate to the upper end thereof, the damper having an upper end configured to contact the lid at a lower portion of the operable range of the lid, to dampen the downward movement of the lid through the lower portion of the range, the upper end of is further configured to disengage from the lid through an upper portion of the operable range of the lid.

11. A trash can as defined in claim 10, wherein the damper is positioned proximate to a hinge assembly that couples the lid and the outer shell.

12. A trash can as defined in claim 11, wherein the hinge assembly included a cam that defines a support surface that interacts with the upper end of the damper.

13. A trash can as defined in claim 10, further comprising:

a link rod having a lower end coupled to the pedal and an upper end coupled to the lid, and a spring coupled to the link rod and the lid.

14. A trash can, comprising:

an outer shell having an upper end and a lower end;

a base secured to the lower end of the outer shell;

a lid pivotally coupled to the upper end of the outer shell for movement between an open position and a closed position, the open position and the closed position defining an operable range for the lid;

a pedal pivotally coupled to the base, and operatively coupled to the lid such that pressing down on the pedal caused the lid to open;

a link having a lower end coupled to the pedal and an upper end coupled to the lid;

a support surface operatively coupled to the lid such that the support surface moves in conjunction with movement of the lid as the lid moves between the open position and the closed position; and a fluid damper mounted within the outer shell and having a piston disposed within a cylinder, the damper further having a first end and a second end in which the damper is mounted such that the first end engages the support surface to dampen the downward movement of the lid, the first end being unconnected to the support surface such that the first end is disengaged from the support surface through an upper portion of the operable range of the lid.

15. A trash can as defined in claim 14, further comprising:

a link rod having a lower end coupled to the pedal and an upper end coupled to the lid, and a support member coupled to the link rod and that provides the support surface.

16. A trash can as defined in claim 15, wherein the support member includes a first portion attached to the lifting rod and a second portion that provides the support surface.

17. A trash can as defined in claim 16, further comprising a spring coupled to the lid and to the support member.

* * * * *